United States Patent [19]

Müeller et al.

[11] 4,172,592

[45] Oct. 30, 1979

[54] STACKING DEVICE FOR ENDLESS PAPERWEBS

[75] Inventors: Gerhard H. Müeller, Taufkirchen; Ernst Puritscher, Munich, both of Fed. Rep. of Germany

[73] Assignee: Siemens Aktiengesellschaft, Berlin & Munich, Fed. Rep. of Germany

[21] Appl. No.: 847,480

[22] Filed: Nov. 1, 1977

[30] Foreign Application Priority Data

Mar. 22, 1977 [DE] Fed. Rep. of Germany ..... 2712571

[51] Int. Cl.[2] ..... B65H 45/00

[52] U.S. Cl. ..... 270/61 F; 270/79

[58] Field of Search ..... 270/61 F, 73, 79, 39

[56] References Cited

U.S. PATENT DOCUMENTS 2,359,417 10/1944 Hand ..... 270/73

3,178,172 4/1965 Lettan ..... 270/79

*Primary Examiner*—Edgar S. Burr

*Assistant Examiner*—A. Heinz

*Attorney, Agent, or Firm*—Hill, Van Santen, Steadman, Chiara & Simpson

[57] ABSTRACT

A stacking device for a prefolded endless paper-web in a paper stacker, in which the paper-web is stacked on a paper support which is designed to move downward in accordance with the stack height, a compensating element being provided which moves downward with the paper support and is adapted to elevate the central portion of the stack, with respect to the folded edges thereof, to reduce the formation of a depression in such central portion resulting from the transversely folded edge portions, means being provided for varying the elevation height of the compensating element as a function of the stack height.

3 Claims, 1 Drawing Figure

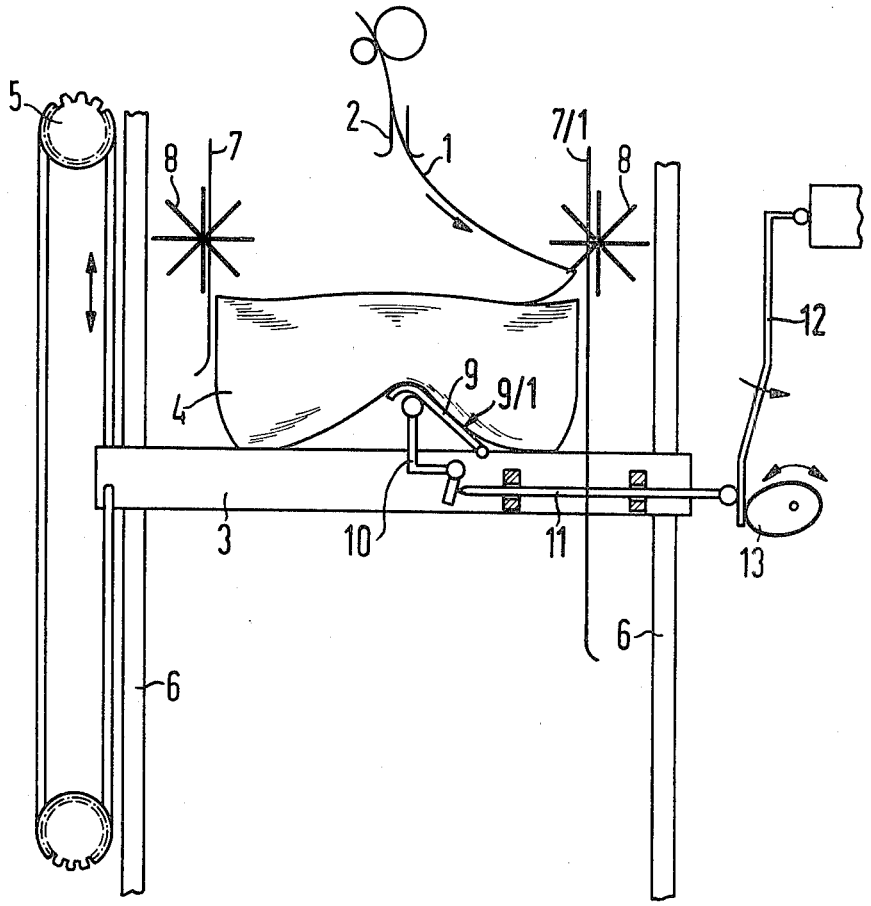
5
8
7
2
1
7/1
8
12
4
9
9/1
3
10
11
13
6
6

STACKING DEVICE FOR ENDLESS PAPERWEBS

BACKGROUND OF THE INVENTION

The present invention relates to a stacking device for a prefolded endless paper-web in a paper stacker, in which the paper-web is atacked on a paper support which is adapted to move downwardly in accordance with the stack height, and which is provided with a compensating element adapted to elevate central portion of the paper stack with respect to the folded edges thereof.

In printer devices employing folded endless paper webs which are to be processed, following the particular processings, the paper web must again be laid down or stacked in folded relation. Units of this type include, for example, mechanical and non-mechanical high-speed printers, in which such units are followed by paper stackers into which the printed paper web is deposited. In this operation the prefolded paper web is laid down in zig-zag layers one above the other in the paper stacker.

In a non-mechanical printer, the standard endless paper, upon passage through the machine, becomes highly heated in the fixing station of the printer, as a result of which the paper acts as if it were in effect being "ironed out". Thus, it stretches and the previously formed folds lose their definition. Even though the paper is laid down with the folds in the correct relative positions, and irrespective of the application of corresponding pressure applied by known type of paddle spindles which are normally provided, it is difficult to reform the stack with its original height and shape. This becomes particularly difficult when relatively light papers are being processed. With increasing stack height, the stack build-up at the edges in the vicinity of the transverse folds, becomes substantially higher than at the central portion of the stack, forming a depression thereat which makes it impossible to achieve proper deposition of the paper, sheet by sheet.

A stacking device is known from U.S. Pat. No. 3,640,521, in which, in a high-speed printer, prefolded endless paper-web is stacked on a paper support, which support is lowered as the height of the paper stack increases. In an effort to avoid the formation of a depression due to the increased height of the transverse fold, an elevated lift member is provided on the paper support, and in addition the paper stack is guided at the front and rear by suitable guide bars.

However, the attachment of a fixed compensating element to the paper support has the disadvantage that it enables only a medium-sized folded paper stack to be suitably compensated. Thus, a paper stack of relatively low height will receive too much upward deflection and a paper stack of relatively greater height will receive too little.

BRIEF SUMMARY OF THE INVENTION

The invention therefore has among its objects, in the production of a stacking device for a prefolded endless paper-web in a paper stacker, an arrangement which makes it possible to compensate for the central depression developing in the paper webs during stacking, whereby, irrespective of the height of the paper stack, a substantially optimum amount of compensating elevation of the central portion of the stack will be provided, thereby eliminating stacking errors, etc.

This objective is achieved, in accordance with the present invention, by an arrangement in which the deflection height of the compensating element supporting the central portion of the paper stack is varied as a function of the stack height.

In a particularly advantageous embodiment, the actuating means may comprise a member or bar extending generally parallel to the direction of the lowering movement of the paper support, which bar is cooperable with a lever system, operatively connected to the compensating elements supporting the central portion of the paper stack, with the bar having a configuration such that a desired movement of the lever system, and thus a desired variation in the operation of the compensating element, may be achieved.

Such bar can further be pivotally or otherwise suitably supported to permit different angular adjustment of the bar and thus provide variations in the actuation of the compensating element. Such adjustment of the bar may be effected, for example, by means of a suitable eccentric mechanism. To provide proper feeding of the first sheet of paper with the sides correctly aligned, the compensating element may be provided with a suitable paper guide surface and may be designed as an elevator flap of L-shaped configuration.

A device constructed in accordance with the present invention has the advantage that throughout the entire stacking duration, and irrespective of the height of the growing paper stack, each individual paper sheet is presented with approximately the same stacking conditions, as a result of which stacking errors are avoided. By the utilizing of an elevator flap in the form of a paper guide surface, the first sheet of a paper stack is automatically laid down with its sides correctly aligned.

The eccentric or equivalent adjusting mechanism makes it readily possible to adjust the deflection height of the elevator flap for differing paper thicknesses.

In a further embodiment of the invention, the device may comprise an elastic receptacle adapted to be filled with a fluid from a suitable pressure-generating device, so that by varying the pressure of the gas or liquid in the elastic receptacle, its external shape may be modified as a function of the stack height.

BRIEF DESCRIPTION OF THE DRAWINGS

In the drawing, the FIGURE illustrates a generally schematic elevational view of a stacking device in accordance with the invention.

DETAILED DESCRIPTION OF THE INVENTION

Referring to the drawing, the reference numeral 1 indicates an endless prefolded paper web or band which is supplied between guide bars 2 to the stacking location at which is disposed a paper supporting member 3 adapted to receive and support the growing paper stack 4. The member 3 is suitably supported for movement along guide bars 6 and may be moved therealong by suitable means such as a motor driven system indicated generally by the numeral 5 which may, for example, be constructed in accordance with the disclosure of U.S. Pat. No. 3,640,521, with the movement corresponding to the maximum height of the paper stack 4. The construction may be such that lowering of the stack will take place automatically under the control of the downward directed weight of the paper support, with the motor 5 in such case operating as a brake.

To adjust and control the positioning of the paper stack, positioning bars 7 may be provided, in the neighborhood of which are disposed respective paddle spindles 8 which are adapted to engage the entering paper web 1 and fold it along the existing crease lines.

Where non-mechanical printers are utilized, as the paper passes through the fixing station of such printer, it becomes highly heated, as a result of which the existing creases are subjected to a more or less "ironing" effect, whereby, irrespective of the use of the paddle spindles 8, a paper stack 4 develops which is higher at the folded edges than it is at the central portion thereof. This kind of a distortion in a paper stack interferes with the continuous properly layered stacking of the paper.

To counter this type of distortion of the paper stack, the paper support 3 is provided with an elevator flap 9 of generally L-shaped configuration, which is connected at one side thereof to the paper support member 3 by means of which the flap can be pivoted upwardly about its connection with the paper support member. Thus, when the main portion of the elevator flap is disposed relatively parallel to the paper support surface, little elevation of the central portion of the paper stack will be effected. However, by suitable upwardly pivotal movement of the elevator flap, for example to the position illustrated in the drawing, the upper face of the paper stack may be disposed in a substantially horizontal plane irrespective of the difference in thickness of the central portion as compared with the folded edge portions.

Such movement of the elevator flap 9 is achieved, in the embodiment illustrated, by means of a pivotal lever 10 which is adapted to be actuated by axial movement of a plunger rod 11 which is suitably supported, for axial movement, from the paper support 3, with the adjacent end of the rod 11 engaging an extension on the lever 9 to translate axial movement of the rod 11 into pivotal movement of the lever 10.

The opposite end of the rod 11 is in sliding engagement with a bar-shaped member 12, extending in the same general direction as the vertical travel of the paper support 3 along the guide bars 6, and is illustrated as being supported at its upper end for pivotal movement, with the position of the bar being controlled by an eccentric cam mechanism 13, whereby an adjustment of the relationship of the bar 12 with respect to the rod 11 can be effected.

As illustrated in the drawing, the bar 12 is provided with a surface, adapted to engage the adjacent end of the rod 11, which is so configurated that a desired motion is transmitted to the rod 11 as the member 3 moves downwardly from its upper position to a lower position such as illustrated in the drawing. Consequently, when the paper support 3 is in its upper position the plunger rod 11 will be in an extreme right-hand position, as viewed in the drawing, rotating the lever 10 in a counterclockwise direction with respect to the position illustrated in the drawing, and position the elevator flap in an approximately horizontal position, but as the paper support 3 moves downwardly the rod 11 will be moved to the left, rotating the lever 10 in a clockwise direction and rotating the elevator flap 9 into a raised position such as illustrated in the drawing. The deflection of the elevator flap is thus varied in accordance with the height of the stacked paper. By adjustment of the eccentric mechanism 13, the angle between the bar 12 and the plunger 11 can be varied, thereby providing a suitable adjustment in the deflection action of the elevator flap 9 for accommodating different kinds and weights of paper.

The elevator flap 9 is additionally provided with a paper guide surface 9/1 which functions to insure automatic feed-in and correct stacking registration of the paper stack, particularly the first standard sheet of a set of flat sheets. To prevent distortion of the overall paper stack as the elevator flap 9 rises, a limiting bar 7/1 may be provided which functions as a stop or abutment for the paper stack. This type of distortion also can be avoided by so constructing the compensating structure that it is symmetrical with respect to the paper stack, i.e. may consist of two elevator flaps, not illustrated, which are disposed in overlapping relation, one of which may be designed as a paper guide surface.

Instead of the elevator flap 9, it is also possible to provide a suitable elastic receptacle, somewhat similar to a flexible tube, which may be selectively filled with a fluid, for example a gas, by means of a pressure generating device, whereby the expansion of the elastic receptacle is effected in accordance with the increasing height of the paper stack. If the receptacle is not to be in direct contact with the paper stack 4, it may be employed in connection with an elevator flap such as the flap 9, whereby the latter is pneumatically raised instead of mechanically as illustrated. It will be appreciated that instead of a gas, it is equally possible to utilize a liquid as the inflating medium.

As a result of the simple and maintenance-free nature of the stacking device illustrated, stacking errors can be avoided and further, it is possible as a result of a special design of the elevator flap, to feed in the first standard sheet of a set of such sheets automatically and achieve proper lateral registration for the desired operation. The device thus achieves a substantial improvement and operating reliability to the overall printing mechanism. Having thus described our invention it will be obvious that although various minor modifications might be suggested by those versed in the art, it should be understood that we wish to embody within the scope of the patent granted hereon all such modifications as reasonably, and properly come within the scope of our contribution to the art.

We claim as our invention:

1. In a stacking device for a prefolded endless paper web in a paper stacker having a paper support upon which a stack of paper web stock may be supported, with said paper support being movable in a vertical direction and adapted to move downwardly in accordance with the size of the stack, the combination of an elevator flap, of generally L-shape in cross section, for elevating the central portion of such a stack with respect to the folded edge portions thereof, said elevator flap being supported on said paper support for pivotal movement relative thereto, and vertically movable with said paper support, an elongated member extending generally parallel to the direction of movement of said paper support, actuating means carried by the latter, for effecting pivotal movement of said elevator flap to operatively raise and lower the same relative to the paper support, and having a portion engageable with said elongated member, the latter having means thereon for transmitting movement, as said support member is lowered, to said actuating means in a direction to effect a raising of said elevator flap as a function of the increase in stack height as represented by the vertical position of said paper support.

2. A stacking device according to claim 1, comprising in further combination, means for adjusting the position of said elongated member relative to said actuating means, for varying the action thereof with respect to said elevator flap.

3. A stacking device according to claim 1, wherein said elevator flap is provided with a paper guide surface.

* * * * *